US006332672B1

(12) United States Patent
Yazaki et al.

(10) Patent No.: US 6,332,672 B1
(45) Date of Patent: Dec. 25, 2001

(54) INK JET RECORDING HEAD INCLUDING A CAP MEMBER SEALING PIEZOELECTRIC VIBRATORS

(75) Inventors: Shiro Yazaki; Shinri Sakai; Tsutomu Nishiwaki, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/069,991

(22) Filed: Apr. 30, 1998

(30) Foreign Application Priority Data

Apr. 30, 1997 (JP) ..... 9-126419
Mar. 10, 1998 (JP) ..... 10-057729

(51) Int. Cl.[7] ..... B41J 2/045
(52) U.S. Cl. ..... 347/70
(58) Field of Search ..... 347/70–72

(56) References Cited

U.S. PATENT DOCUMENTS 5,499,042 3/1996 Yanagawa ..... 347/69
5,670,999 * 9/1997 Takeuchi et al. ..... 347/71 X

FOREIGN PATENT DOCUMENTS 0 600 382 6/1994 (EP) ..... B41J/2/16
0 738 599 10/1996 (EP) ..... B41J/2/045
0 863 007 9/1998 (EP) ..... B41J/2/14
6-122187 5/1994 (JP) ..... B41F/31/14
6-122197 5/1994 (JP) ..... B41J/2/045

* cited by examiner

*Primary Examiner*—Max Noori
*Assistant Examiner*—C. Dickens
(74) *Attorney, Agent, or Firm*—Sughrue, Mion, Zinn, Macpeak & Seas, PLLC

(57) ABSTRACT

An ink jet recording head comprises: a passage form substrate having, a diaphragm forming a part of a pressure generating chamber communicating with a nozzle aperture and at least the upper surface of which acts as a lower electrode, and a piezoelectric vibrator including a piezoelectric material layer formed on the surface of the diaphragm, an upper electrode formed on the surface of the piezoelectric material layer and a piezoelectric active part formed in an area opposite to the pressure generating chamber; a cap member joined to the side of the piezoelectric material layer of the passage formed substrate for sealing space in a state in which space to extent that a movement is not prevented is secured; and a flexible portion for absorbing the change of pressure in the space of the cap member.

12 Claims, 10 Drawing Sheets

INK JET RECORDING HEAD INCLUDING A CAP MEMBER SEALING PIEZOELECTRIC VIBRATORS

BACKGROUND OF INVENTION

The present invention relates to an ink jet recording head for expanding or contracting a part of a pressure generating chamber communicating with a nozzle aperture by an actuator for flexural oscillation so as to jet an ink droplet from the nozzle aperture.

An ink jet recording head has two types of a piezoelectric vibration type for mechanically deforming a pressure generating chamber and pressurizing ink and a bubble jet type provided with a heater element in a pressure generating chamber for pressurizing ink by the pressure of bubbles generated because of the heat of the heater element. The piezoelectric vibration type of recording head is further classified into two types of a first recording bead using a piezoelectric vibrator displaced in an axial direction and a second recording head using a piezoelectric vibrator displaced by flexure. As for the first recording head, although high-speed driving is enabled and recording in high density, there is a problem that the number of manufacturing steps in large because cutting is required for machining a piezoelectric vibrator and three-dimensional assembly is required when a piezoelectric vibrator is fixed to a pressure generating chamber.

In the meantime, as for the second recording head, as a silicon monocrystalline substrate is used for base material, a pressure generating chamber and a passage such as a reservoir are formed by anisotropic etching, an elastic film can be extremely thin and the pressure generating chamber and a piezoelectric vibrator can be formed very precisely by forming the piezoelectric vibrator using a film forming technique such as sputtering piezoelectric material. Also, the opening area of the pressure generating chamber can be reduced as much as possible and recording density can be enhanced.

However, as a metallic plate is still used for a nozzle plate to maintain the working precision of a nozzle aperture, there is a problem that the whole recording head is distorted due to differential thermal expansion when the piezoelectric vibrator is fixed by burning. Such a problem can be solved by using a thermal expansion characteristic adjusting member disclosed in Japanese Patent Application Unexamined Publication No. Hei. 6-122197. However, there is a problem that if a piezoelectric vibrator is constituted by sputtering piezoelectric material, the piezoelectric vibrator is thin and a higher electric field is applied in the case of driving at the same voltage, compared with a piezoelectric vibrator constituted by burning a green sheet. Therefore, if humidity in the atmosphere is absorbed, leak current between driving electrodes is readily increased and finally, dielectric breakdown is caused.

SUMMARY OF THE INVENTION

The present invention is made to solve such problems and the object is to provide an ink jet recording head in which the failure of the operation caused by the change of a piezoelectric vibrator formed using film forming technique due to external environment such as humidity is solved by forming a sealed atmosphere and a problem caused by the change of pressure in the sealed atmosphere is solved.

According to the first aspect to the invention, there is provided an ink jet recording head comprising: a nozzle;

a passage formed substrate having partitions forming at least a row of pressure generating chambers, which is communicated with said nozzle;

an elastic film forming a part of the pressure generating chambers;

a piezoelectric vibrator formed on a diaphragm opposite to said pressure generating chamber; and a cap member joined to the side of the piezoelectric vibrator of the passage formed substrate for sealing space in a state in which space to extent that a movement is not prevented is secured; and pressure change absorbing means for absorbing the change of pressure in the space of the cap member.

In the first aspect of the invention, the piezoelectric active part is insulated from outside by the cap member and pressure inside the cap is kept fixed by the pressure change absorbing means.

According to the second aspect of the invention, there is provided the ink jet recording head according to the first aspect, wherein the pressure change absorbing means is an elastic porous member provided in the cap member.

In the second aspect, the variation of pressure inside the cap member is absorbed by the elastic porous member provided in the cap member.

According to the third aspect of the invention, there is provided the ink jet recording head according to the first aspect, wherein: the pressure change absorbing member is a flexible part provided in the cap member; and the space in the cap member is opposite to the outside via the flexible part.

In the third embodiment, the change of pressure in the cap member is absorbed by the flexible part.

According to the fourth aspect of the invention, there is provided the ink jet recording head according to the first aspect, wherein: a dummy pressure generating chamber to which ink is not supplied is provided next to the pressure generating chamber; and the pressure change absorbing means is a flexible plate forming a boundary between the dummy pressure generating chamber and the space in the cap member.

In the fourth aspect, the change of pressure in the cap member is absorbed by the flexible plate forming the boundary between the dummy pressure generating chamber and the space in the cap member.

According to the fifth aspect of the invention, there is provided the ink jet recording head according to the fourth aspect, wherein the flexible plate is defined by at least elastic film of the dummy pressure generating chamber.

In the fifth aspect, the change of pressure in the cap member is absorbed by the diaphragm.

According to the sixth aspect of the invention, there is provided the ink jet recording head according to the first aspect, wherein the whole cap member is made of flexible material.

In the sixth aspect, the change of pressure in the cap member is absorbed by the whole cap member.

According to the seventh aspect of the invention, there is provided the ink jet recording head according to the sixth aspect, wherein the flexible material is paper the inner surface of which is coated or aluminum.

In the seventh embodiment, the change of pressure in the cap member is effectively absorbed.

According to the eighth aspect of the invention, there is provided the ink jet recording head according to either six or seventh aspect, wherein the flexible material is joined to the passage formed substrate by welding aluminum.

In the eighth aspect, the cap member is readily and securely joined to the passage formed substrate.

According to the ninth aspect of the invention, there is provided the ink jet recording head according to any one of the preceding aspects, wherein: the pressure generating chamber is formed by applying anisotropic etching to a silicon monocrystalline substrate; and each layer of the piezoelectric vibrator is formed by forming a film and lithography.

In the ninth aspect, a large number of ink jet recording heads provided with high density nozzle apertures can be relatively easily manufactured.

According to the tenth aspect of the invention, there is provided the ink jet recording head according to any one of the preceding aspects, wherein: a reservoir connected to the pressure generating chamber is formed in the passage formed substrate; and a nozzle plate provided with the nozzle apertures is joined.

In the tenth aspect, an ink jet recording head for jetting ink from a nozzle aperture can be readily realized.

According to the eleventh aspect of the invention, there is provided the ink jet recording head according to any one of the first to ninth aspects, wherein a passage unit for forming a common ink chamber for supplying ink to the pressure generating chamber and a passage for connecting the pressure generating chamber and the nozzle aperture is joined to the passage formed substrate.

In the eleventh aspect, ink is jetted from a nozzle aperture via the passage unit.

DETAILED DESCRIPTION OF THE PREFERRED EMBODIMENT

Embodiments of the present invention will be described in detail below.

First Embodiment

Figure 1:
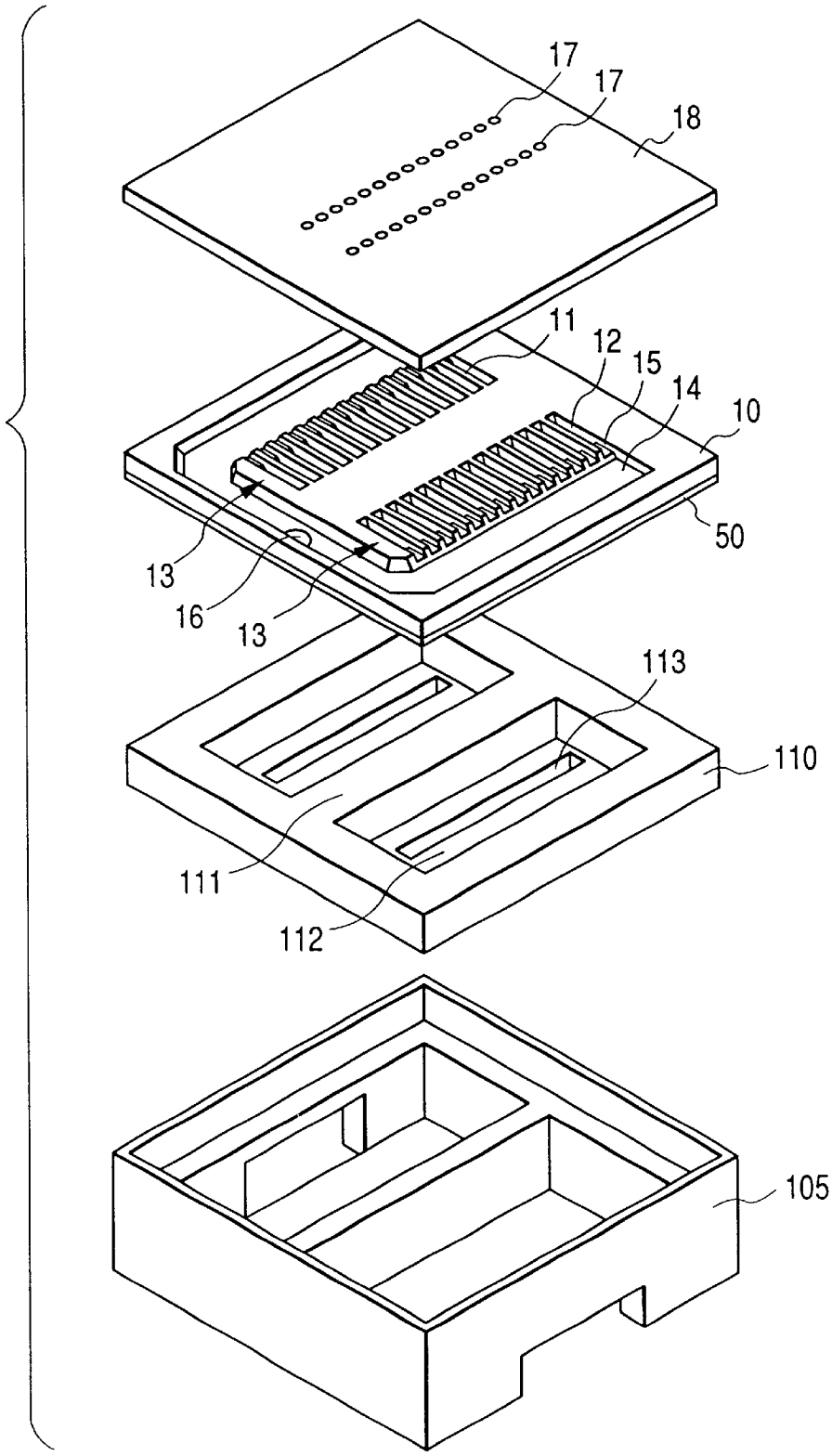
FIG. 1 is an exploded perspective drawing showing an ink jet recording head according to an embodiment of the present invention.
Figure 2A:
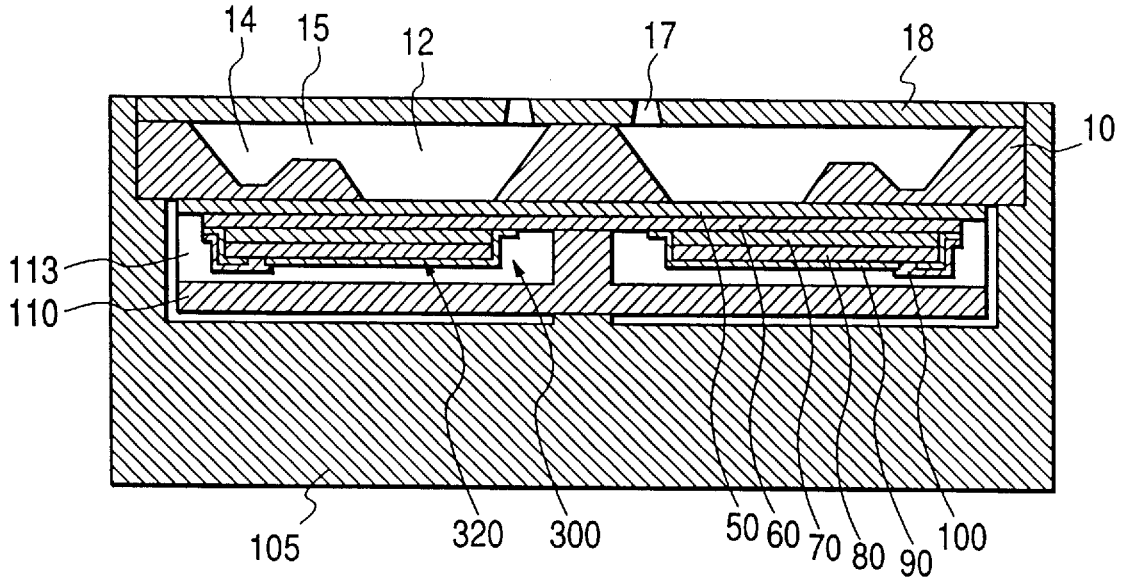
FIGS. 2(*a*) and 2(*b*) show sectional structure of the ink jet recording head according to the embodiment of the present invention in the longitudinal direction of a pressure generating chamber and in the direction of the array of pressure generating chambers.
Figure 2B:
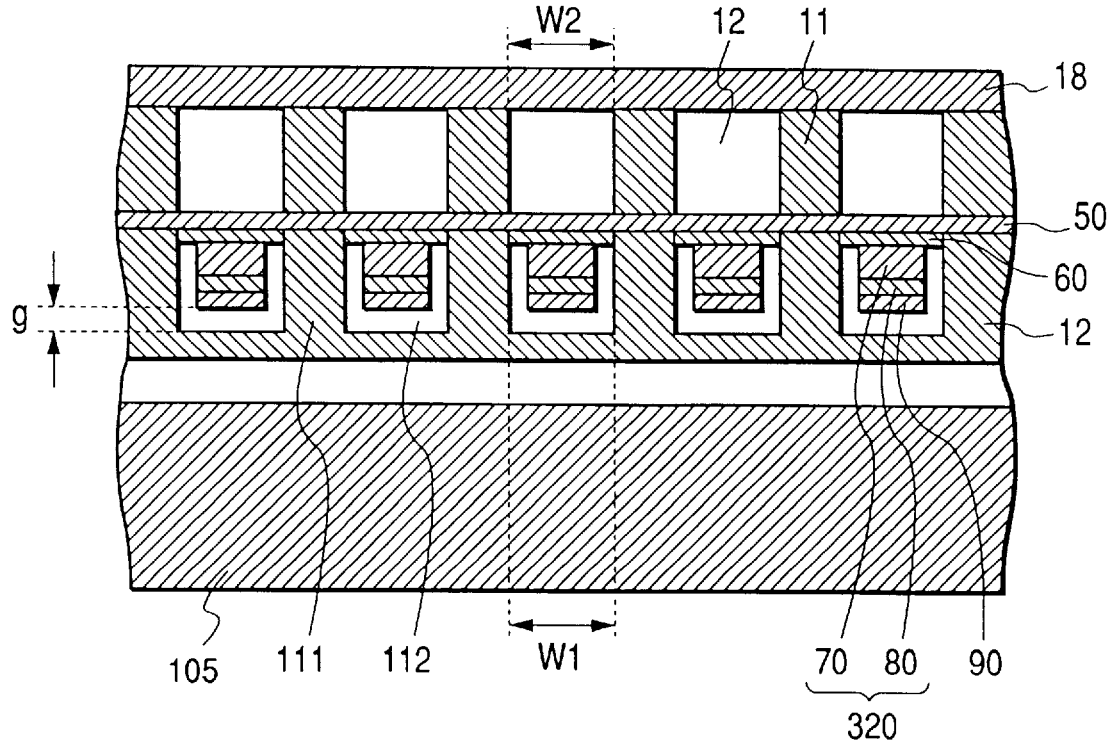
Figure 3A:
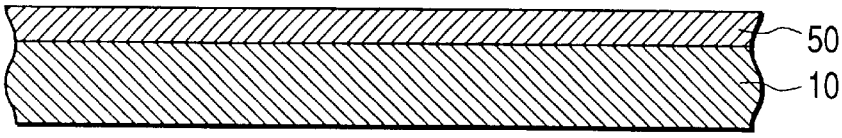
FIGS. 3(*a*) to 3(*e*) show a thin film manufacturing process in the first embodiment of the present invention.
Figure 3B:
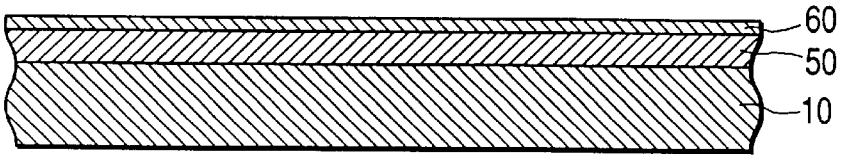
Figure 3C:
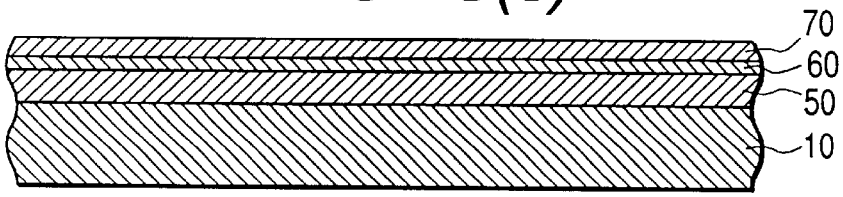
Figure 3D:
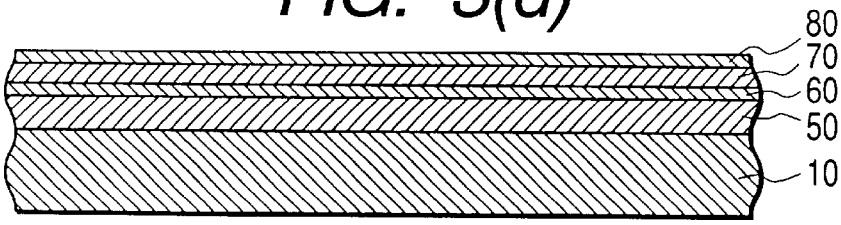
Figure 3E:
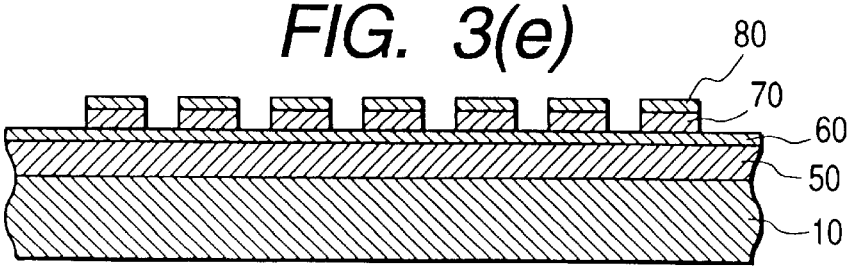

FIG. 1 is an assembly perspective drawing showing an ink jet recording head according to a first embodiment of the present invention and FIGS. 2(*a*) and 2(*b*) show the sectional structure of a pressure generating chamber respectively in the longitudinal direction and in the direction of the width.

As shown in FIGS. 1 to 2(*b*), a passage formed substrate 10 comprises a silicon monocrystalline substrate with the face orientation of (110) in this embodiment. For the passage formed substrate 10, a passage formed substrate with the thickness of approximately 150 to 300 $\mu$m is normally used, desirably a passage formed substrate with the thickness of approximately 180 to 280 $\mu$m and preferably a passage formed substrate with the thickness of approximately 220 $\mu$m are suitable. This is because array density can be enhanced, keeping the rigidity of a partition between adjacent pressure generating chambers.

One face of the passage formed substrate 10 is an open face and an elastic film 50 with the thickness of 1 to 2 $\mu$m comprising silicon dioxide formed by thermal oxidation beforehand is formed on the other face.

In the meantime, two rows 13 of pressure generating chambers 12 partitioned by plural partitions 11, a reservoir 14 arranged approximately in the shape of a letter C so that three directions of two rows 13 of pressure generating chambers 12 are surrounded by the reservoir and ink supply ports 15 respectively connecting each pressure generating chamber 12 and the reservoir 14 under fixed passage resistance are formed on the side of the open face of the passage formed substrate 10 by anisotropically etching the silicon monocrystalline substrate. An ink lead-in port 16 for supplying ink to the reservoir 14 from outside is formed approximately in the center or the reservoir 14.

In the above anisotropic etching, when a silicon monocrystalline substrate is dipped in alkaline solution such as KOH, the silicon monocrystalline substrate is gradually eroded, a first face (111) perpendicular to a face (110) and a second face (111) at an angle of approximately 70° with the first face (111) and at an angle of approximately 35° with the above face (110) appear and the above anisotropic etching is done utilizing a property that the etching rate of the face (111) is approximately 1/180, compared with the etching rate of the face (110). Precise processing can be executed based upon processing in the depth of a parallelogram formed by the two first faces (111) and the diagonal two second faces (111) by such anisotropic etching and the pressure generating chambers 12 can be arrayed in high density.

In this embodiment, the longer side of each pressure generating chamber 12 is formed by the first face (111) and the shorter side is formed by the second face (111). The pressure generating chamber 12 is formed by etching the passage formed substrate 10 up to the elastic film 50. The quantity in which the elastic film 50 is dipped in alkaline solution for etching a silicon monocrystalline substrate is extremely small. Each ink supply port 15 communicating with one end of each pressure generating chamber 12 is formed so that the ink supply port is shallower than the pressure generating chamber 12. That is, the ink supply port 15 is formed by etching halfway in the direction of the thickness of the silicon monocrystalline substrate (half-etching). Half-etching is done by adjusting etching time.

A nozzle plate 18 in which nozzle apertures 17 each of which communicates with the ink supply port 15 in each pressure generating chamber 12 are made is fixed to the side of the open face of the passage formed substrate 10 via an adhesive, a thermically welded film and others. The nozzle plate 18 comprises glass ceramics or stainless steel and others the thickness of which is 0.1 to 1 mm for example and the coefficient of linear expansion of which is 2.5 to 4.5[$\times 10^{-6}$/° C.] for example at 300° C. or less. One surface of the nozzle plate 18 covers one face of the passage formed substrate 10 overall and also functions as a reinforcing plate for protecting the silicon monocrystalline substrate from impact and external force.

The size of the pressure generating chamber 12 for applying ink droplet jetting pressure to ink and the size of the nozzle aperture 17 from which ink droplets are jetted are optimized according to the quantity of jetted ink droplets, jetting speed and a jetting frequency. For example, if 360 ink droplets per inch are to be recorded, the nozzle aperture 17 is required to be precisely formed at the groove width of a few tens $\mu$m.

In the meantime, a lower electrode film 60 with the thickness of approximately 0.5 $\mu$m for example, a piezoelectric film 70 with the thickness of approximately 1 $\mu$m for example and an upper electrode film 80 with the thickness of approximately 0.1 $\mu$m for example are laminated on the elastic film 50 on the reverse side to the open face of the passage formed substrate 10 in a process described later and constitutes a piezoelectric vibrator 300 (a piezoelectric element). As described above, the piezoelectric vibrator 300 is constructed by the lower electrode film 60, the piezoelectric film 70 and the upper electrode film 80. In general, a common electrode is selected from the lower electrode 60 or the upper electrode 80 of the piezoelectric vibrator 300, and the other electrode and the piezoelectric film 70 are formed by patterning in each pressure generating chamber 12. In this structure, a piezoelectric active part 320 is constructed by the piezoelectric film 70 and one of the lower electrode 60 and the upper electrode 80 which is formed through the patterning, and is caused to the piezoelectric deformation by applying the voltage the both electrodes.

In this embodiment, the lower electrode film 60 is a common electrode for the piezoelectric vibrator 300 and the upper electrode film 80 is an individual electrode of the piezoelectric vibrator 300, however, they may be also reverse for the convenience of a driving circuit and wiring. In any case, a piezoelectric active part is formed every pressure generating chamber 12. Further, it is possible to commonly use the elastic film 50 and the lower electrode 60 together.

In this embodiment, the piezoelectric active part 320 is defined by the upper electrode 60 and the piezoelectric film 70 formed on a region facing the pressure generating chamber 12 by patterning, and the piezoelectric film 70 and the upper electrode 80 comprising the piezoelectric active part 320 are continuously formed until a region confronted with the reservoir 14 and the ink supply ports 15 is formed. Further, the upper electrode 80 facing the reservoir 14 is connected to a read electrode 100 at a region facing the reservoir 14 though a contact hole 90*a* is described later.

Referring to FIGS. 3(*a*) to 4(*c*), a process in which the piezoelectric film 70 and others are formed on the passage formed substrate 10 composed of a silicon monocrystalline substrate will be described below.

As shown in FIG. 3(*a*), first, a wafer of a silicon monocrystalline substrate to be the passage formed substrate 10 is thermally oxidized in a diffusion furnace with the temperature of approximately 1100° C. to form the elastic film 50 comprising silicon dioxide.

Next, as shown in FIG. 3(*b*), the lower electrode film 60 is formed by sputtering. For the material of the lower electrode film 60, platinum (Pt) and others are suitable. This is because the piezoelectric film 70 described later formed by sputtering and a sol-gel transformation method is required to be burned at the temperature of approximately 600 to 1000° C. in the atmosphere or oxygen atmosphere after the film is formed and crystallized. That is, for the material of the lower electrode film 60, conductivity is required to be kept in such a high-temperature and oxygen atmosphere, particularly, if lead zirconate titanate (PZT) is used for the piezoelectric film 70, it is desirable that the change of conductivity by the diffusion of PbO is small and for these reasons, Pt is suitable.

Next, as shown in FIG. 3(*c*), the piezoelectric film 70 is formed. Sputtering may be also used for forming the piezoelectric film 70, however, in this embodiment, so-called sol-gel transformation method in which so-called sol dissolved and dispersed using a metallic organic substance as a solvent is gelled by application and drying and further, the piezoelectric film 70 comprising metallic oxide can be acquired by burning at high temperature is used. For the material of the piezoelectric film 70, PZT is suitable in case PZT is used for an ink jet recording head.

Next, as shown in FIG. 3(*d*), the upper electrode film 80 is formed. The material of the upper electrode film 80 has only to be conductive and many metals such Al, Au, Ni and Pt, conductive oxide and others can be used. In this embodiment, Pt is formed by sputtering.

Next, as shown in FIG. 3(*e*), the upper electrode film 80 and the piezoelectric film 70 are patterned so that one piezoelectric vibrator is arranged for each pressure generating chamber 12. FIG. 3(*e*) shows a case that the piezoelectric film 70 is patterned using the same pattern as that for the upper electrode film 70, however, as described above, the piezoelectric film 70 is not necessarily required to be patterned. This is because if voltage is applied to the upper electrode film 80 patterned as an individual electrode, an electric filed is applied only between the upper electrode film 80 and the lower electrode film 60 which is a common electrode and has no effect upon the other part. However, in this case, as the application of large voltage is required for obtaining the same excluded volume, it is desirable that the piezoelectric film 70 is also patterned. Afterward, the lower electrode film 60 may be also patterned to remove an unnecessary part, for example the vicinity inside the edge on both sides in the direction of the width of the pressure generating chamber 12. The removal of the lower electrode film 60 is not necessarily required and if the lower electrode film is removed, the whole film is not removed but may be also thinned in the direction of the thickness.

As for patterning, after a resist pattern is formed, patterning is executed by etching and others.

As for a resist pattern, a negative resist is applied by spin and others and a resist pattern is formed by exposure, developing and baking using a mask in a predetermined shape. A positive resist may be also used in place of the negative resist.

Etching is executed using a dry etching device, for example an ion milling device. After etching, a resist pattern is removed using an ashing device and others.

For a dry etching method, a reactive etching method and others may be also used in addition to an ion milling method. Wet etching may be also used in place of dry etching, however, as patterning precision is a little inferior to that in dry etching and material for the upper electrode film 80 is also limited, it is desirable that dry etching is used.

Figure 4A:
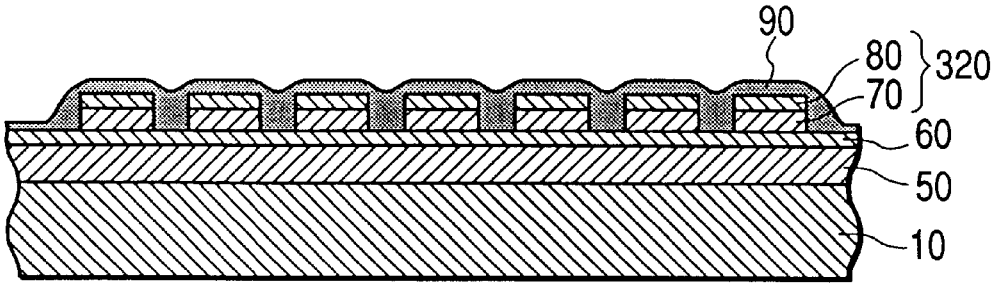
FIGS. 4(*a*) to 4(*c*) show the thin film manufacturing process in the first embodiment of the present invention.
Figure 4B:
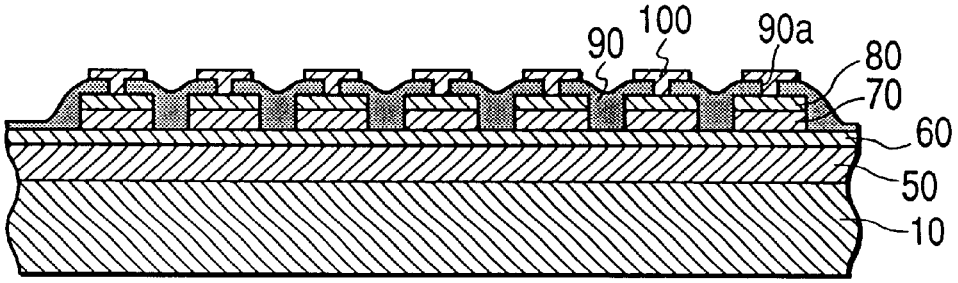
Figure 4C:
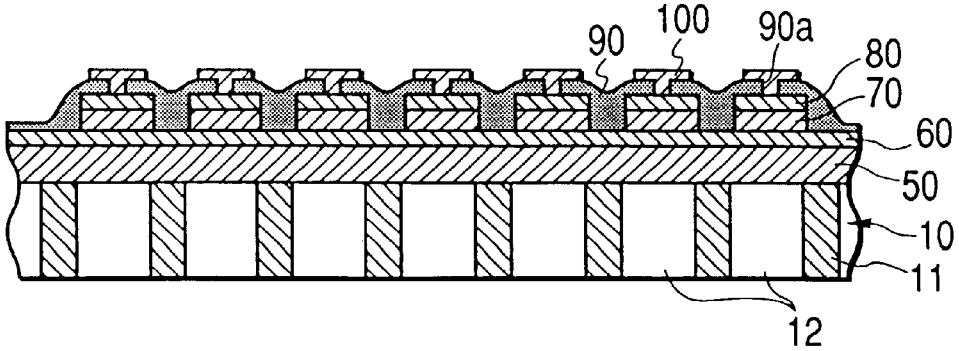

Next, as shown in FIG. 4(*a*), an insulating layer 90 is formed so that it covers the periphery of the upper electrode film 80 and the side of the piezoelectric film 70. For the material of the insulating layer 90, in this embodiment, negative photosensitive polyimide is used.

Next, as shown in FIG. 4(*b*), a contact hole 90*a* is formed in a part opposite to each communicating part 14 by patterning the insulating layer 90. The contact hole 90*a* is provided to connect a lead electrode 100 described later and the upper electrode film 80.

Next, the lead electrode 100 is formed by patterning after an electric conductor such as Cr—Au is formed overall.

The film forming process is as described above. After the film is formed as described above, pressure generating chambers 12 and others are formed by anisotropically etching a silicon monocrystalline substrate using the above alkaline solution as shown in FIG. 4(*c*).

In this embodiment, a cap member 110 provided with space to the extent that the driving of the piezoelectric active part is not prevented for sealing the piezoelectric active part is provided on the elastic film 50 on the side of the piezoelectric active part.

As shown in FIG. 1 cap member 110 is provided with a partitioning wall 111 for partitioning a concave portion 112 composed of space for isolating the piezoelectric active part in an area opposite to each row 13 of pressure generating chambers 12 on the side on which the cap member is joined of the elastic film 50.

The cap member 110 is fixed on the surface of the elastic film 50 by an adhesive and others to seal each piezoelectric active part in each concave portion. In this embodiment, the cap member is bonded to the elastic film 50, however, the present invention is not limited to this, for example the piezoelectric film 70 is removed and the cap member may be also bonded to the lower electrode film 60. In any case, the cap member 110 can be securely bonded.

Figure 5:
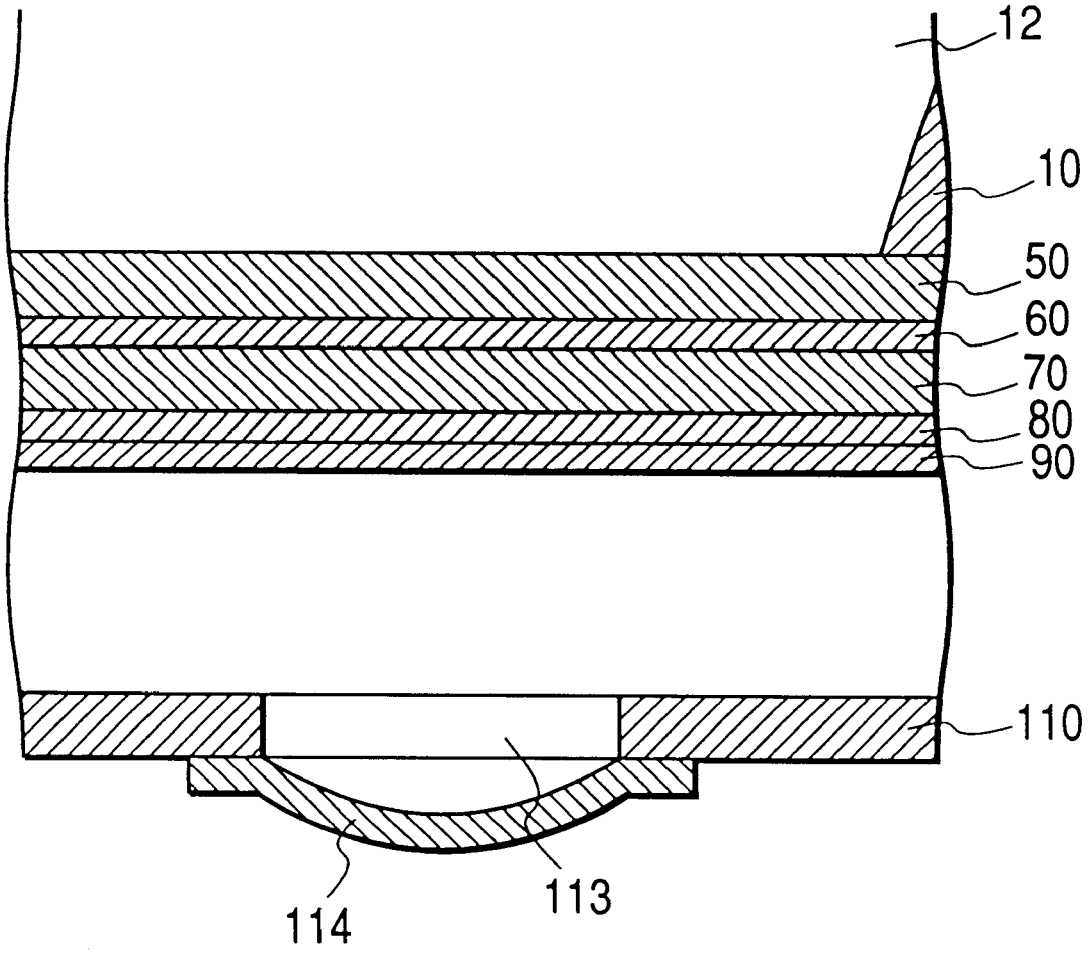
FIG. 5 schematically shows a flexible part.

In this embodiment, a through groove 113 for connecting the concave portion 112 and the outside is formed in the direction of the row 13 in the approximately center of the concave portion 112 in the direction of the row 13 of the pressure generating chambers and the outside opening of the through groove 113 is closed by a flexible part 114 for absorbing the change of pressure in the concave portion 112 by deformation. The flexible part 114 is formed by a thin film of elastically deformable material such as resin, rubber and metal and as shown in a schematic drawing in FIG. 5, the flexible can be readily deformed according to the change of pressure in the concave portion 112.

The size of the through groove 113 and the flexible part 114 is not particularly limited and they have only to be the size which can absorb the change of pressure in each concave portion 112.

Owing to such constitution, the piezoelectric active part is scaled by the cap member 110 and the failure of operation caused by external environment is prevented. Even if pressure in the concave portion 112 scaling the piezoelectric active part varies, pressure in the concave portion 112 can be kept fixed because the flexible part 114 is deformed. Therefore, the failure of the operation of the piezoelectric active part caused by the change of pressure in the concave portion 112 can be readily prevented.

In a series of film formation and anisotropic etching described above, multiple chips are simultaneously formed in one wafer and after the process is finished, the wafer is divided every passage formed substrate 10 according to one chip. The divided passage formed substrate 10 is sequentially bonded to the nozzle plate 18 and the cap member 110 to be an ink jet recording head. Afterward, the passage formed substrate is fixed in a holder 105, mounted on a carriage and built in an ink jet recording apparatus.

The ink jet head constituted as described above takes ink from the ink lead-in port 16 connected to external ink supply means not shown, after the ink jet head fills the inside from the reservoir 14 to the nozzle aperture 17 with ink, the ink jet head applies voltage between the lower electrode film 60 and the upper electrode film 80 via the lead electrode 100 according to a recording signal from an external driving circuit not shown, pressure in the pressure generating chamber 12 is increased by flexing the elastic film 50 and the piezoelectric film 70 and an ink droplet is jetted from the nozzle aperture 17.

Second Embodiment

Figure 6:
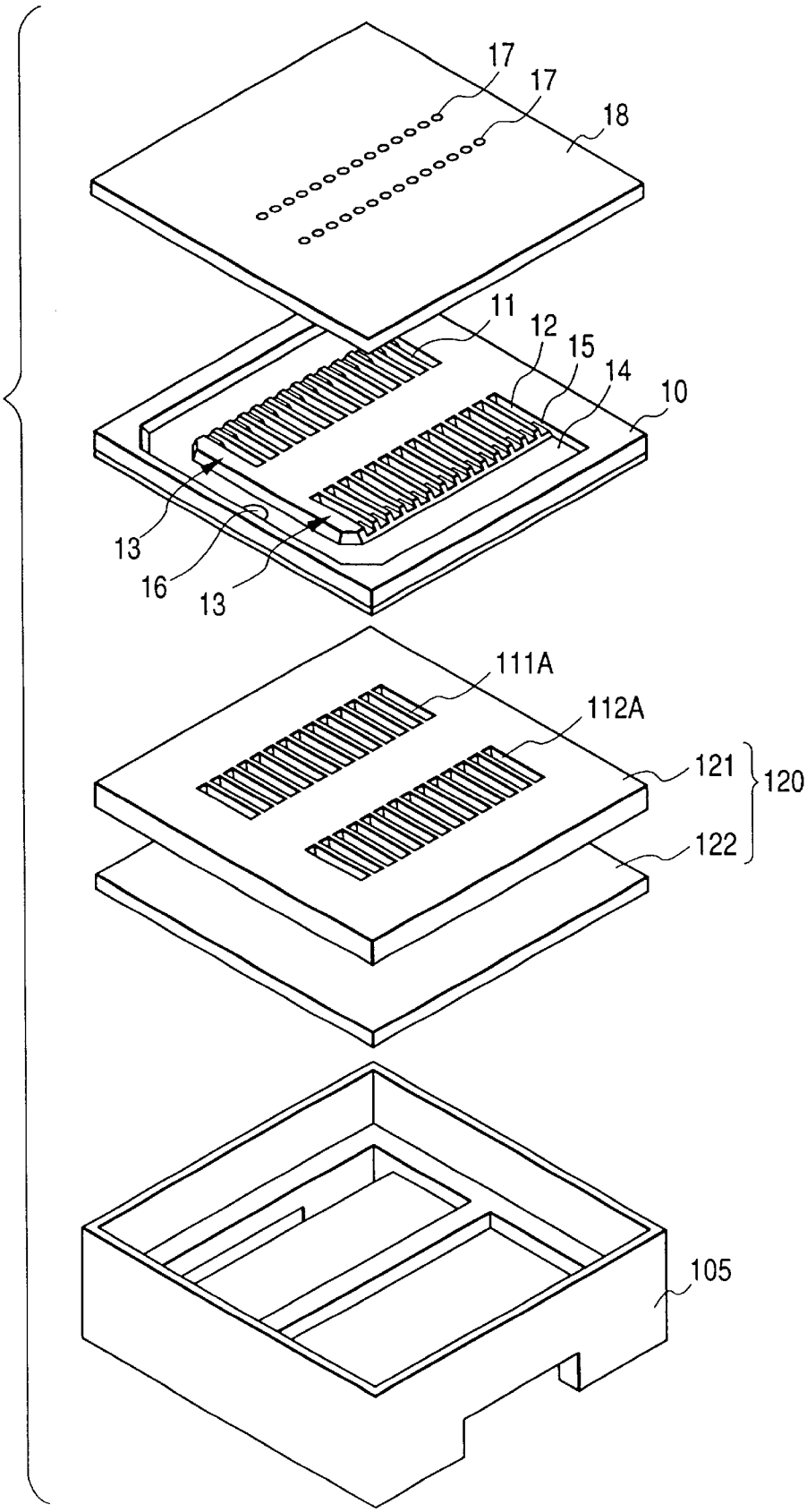
FIG. 6 is an exploded perspective drawing showing an ink jet recording head according to a second embodiment of the present invention.
Figure 7:
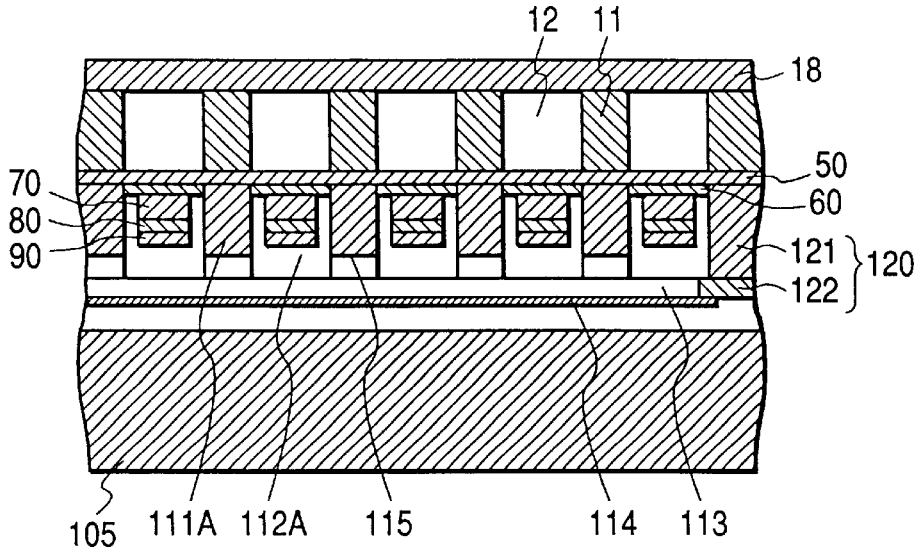
FIG. 7 shows the sectional structure of the ink jet recording bead according to the second embodiment of the present invention in the direction of array of pressure generating chambers.

FIG. 6 is an assembly perspective drawing showing an ink jet recording head according to a second embodiment and FIG. 7 shows the sectional structure in the second embodiment in the direction of the width of a pressure generating chamber.

In this embodiment, as shown in FIGS. 6 and 7, a cap member 120 is constituted by a first cap member 121 provided with a partitioning wall 111A inside for partitioning a concave portion 112A which has space to the extent that the driving of a piezoelectric vibrator is not prevented and a second cap member 122 for sealing one surface of the first cap member 121, and the first cap member 121 and the second cap member 122 are fixed by an adhesive and others. This embodiment is the same as the first embodiment except that a communicating part 115 connecting adjacent concave portions 112A is provided at the end on the side reverse to a passage formed substrate 10 of the partitioning wall 111A in the approximately center in the longitudinal direction of a pressure generating chamber 12 and communicates with all the concave portions 112A corresponding the row 13 of pressure generating chambers 12.

Therefore, in this embodiment, as piezoelectric active part can be also cut off outside owing to the cap member 120 and the failure of operation caused by external environment can be also prevented as in the first embodiment. As the change of pressure in each concave portion 112A is absorbed by a flexible part 114 via the communicating hole 115, pressure inside the cap 120 can be kept fixed. Hereby, the failure of the operation of the piezoelectric active part caused by the change of inside pressure can be prevented.

In this embodiment, the communicating hole 115 is provided to the partitioning wall 111A, however, as each pressure generating chamber 12 communicates owing to a through groove 113 if the through groove 113 is provided to all the pressure generating chambers 12, the similar effect can be obtained without the communicating hole 115.

Third Embodiment

Figure 8:
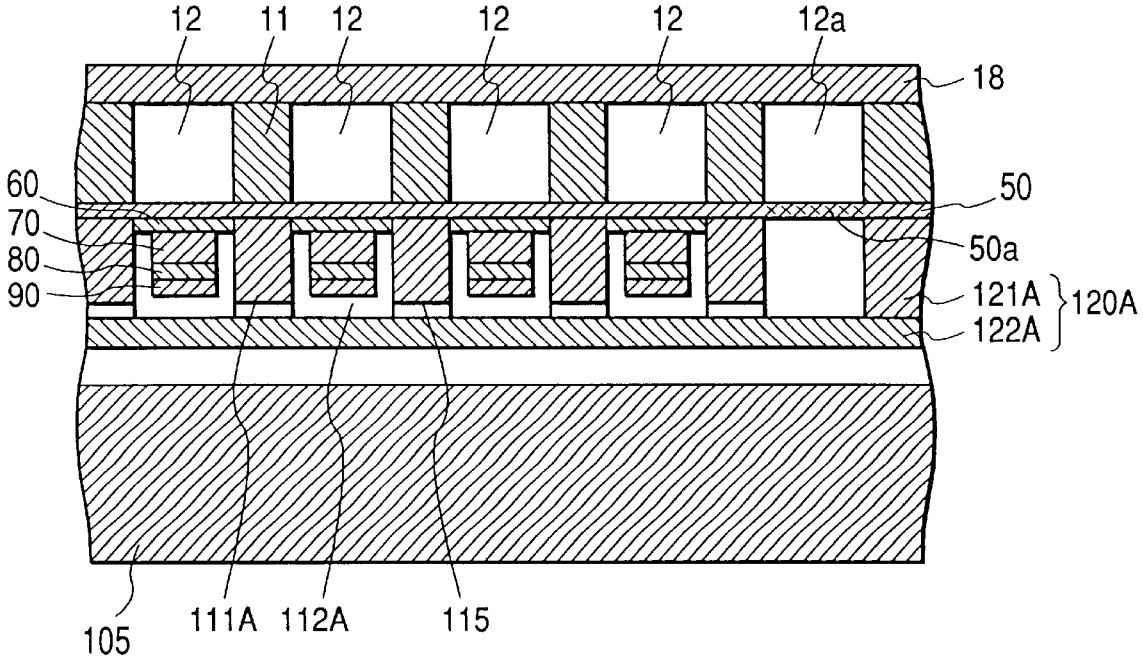
FIG. 8 shows the sectional structure of an ink jet recording head according to a third embodiment of the present invention in the direction of array of pressure generating chambers.

FIG. 8 shows sectional structure according to a third embodiment in the direction of the width of a pressure generating chamber.

A shown in FIG. 8, this embodiment is basically the same as the second embodiment except that a pressure generating chamber 12 located at one end of the row 13 of pressure generating chambers is a dummy pressure generating chamber 12*a*, a lower electrode film 60 in an area opposite to the pressure generating chamber 12*a* is removed and an elastic film 50*a* functions as a flexible plate for absorbing the change of pressure in a concave portion 112A.

According to such constitution, pressure in the concave portion 112A is kept fixed because the elastic film 50*a* is deformed according to the change of pressure in the concave portion 112A and the failure of the operation of a piezoelectric active part caused by the change of pressure is prevented. It is desirable to enhance the effect of absorbing pressure that the dummy pressure generating chamber 12*a* communicates with the outside.

In this embodiment, only the elastic film 50*a* is provided to a part opposite to the dummy pressure generating chamber 12*a*, however, the present invention is not limited to this and for example, the lower electrode film 60 may be also left, and the lower electrode film and a part of the elastic film 50 may be also removed. The flexible plate on a boundary between the dummy pressure generating chamber 12*a* and a cap member 120 is not limited to a diaphragm and may be also formed by another member.

Fourth Embodiment

Figure 9A:
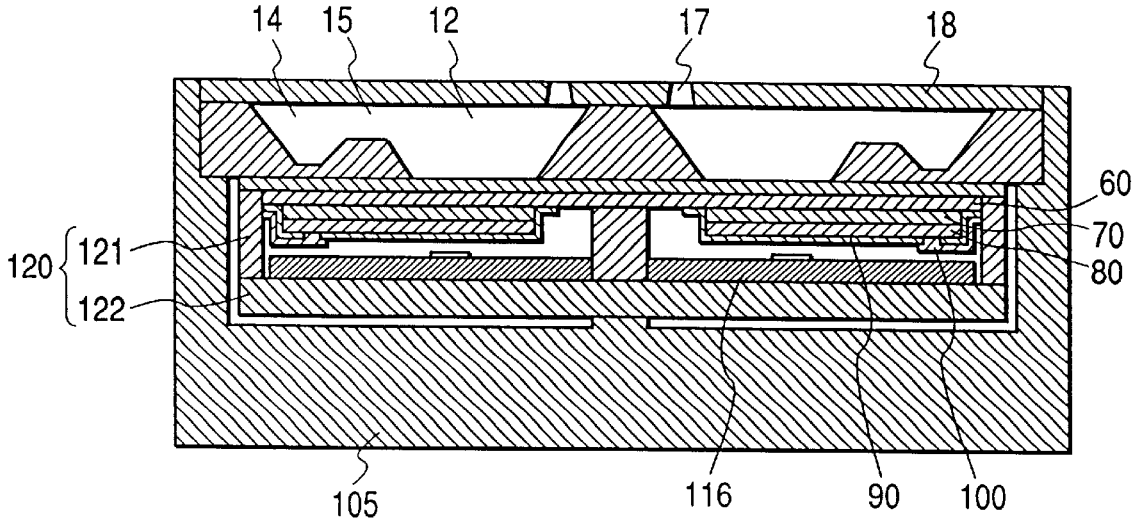
FIGS. 9(*a*) and 9(*b*) show the sectional structure of an ink jet recording head according to a fourth embodiment of the present invention in the longitudinal direction of a pressure generating chamber and in the direction of the array of pressure generating chambers.
Figure 9B:
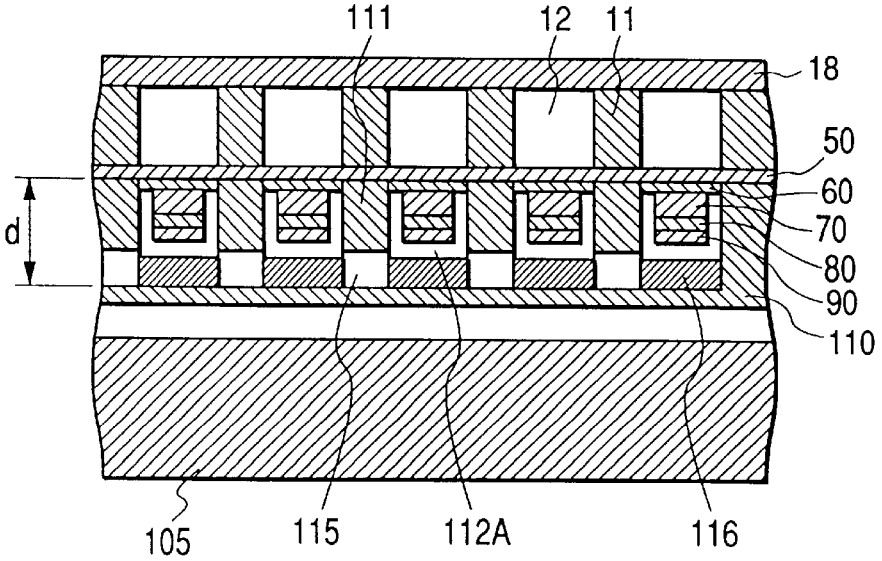

FIGS. 9 show sectional structure according to a fourth embodiment in she longitudinal direction of a pressure generating chamber and in the direction of the width.

This embodiment is the same as the second embodiment except that a concave portion 112A of a cap member 120 is formed so that the concave portion is deep as shown in FIG. 9 in place of providing a flexible part for absorbing the change of pressure inside the cap 120 and a porous member 116 which is impregnated with silicon oil hardly including moisture and others is provided at the back of the concave portion 112A so that the upper electrode film 80 is not touched.

According to this embodiment, as in the above embodiments, a piezoelectric active part can be cut off the outside and the failure of the operation caused by external environment can be prevented. As the change of pressure inside the cap 120 is absorbed by the deformation of the porous member 116 impregnated with silicon oil and others, the failure of the operation of the piezoelectric active part caused by the change of inside pressure can be prevented.

In this embodiment, as a communicating hole 115 connecting adjacent concave portions 112A is formed, the porous member 116 is impregnated with silicon oil and others so that the change of pressure inside each connected concave portion 112A can be absorbed, however, if the porous member 116 includes closed cells, a porous member 116 not impregnated with silicon oil and others may be also provided and hereby, the change of inside pressure can be sufficiently absorbed.

Fifth Embodiment

Figure 10:
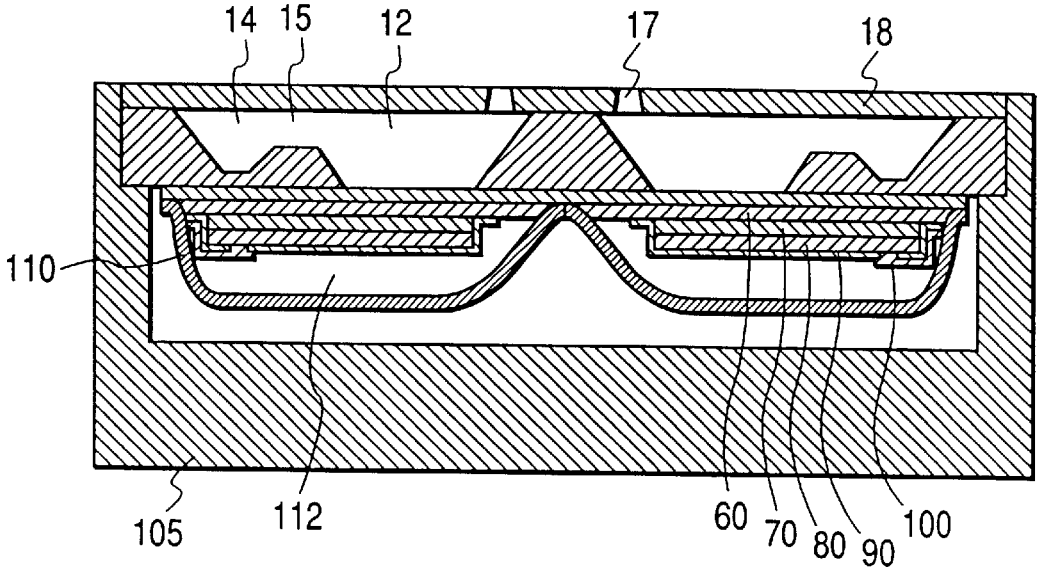
FIG. 10 shows the sectional structure of an ink jet recording head according to a fifth embodiment of the present invention in the longitudinal direction of a pressure generating chamber.

FIG. 10 shows sectional structure according to a fifth embodiment in the longitudinal direction of a pressure generating chamber.

Basic structure in this embodiment is the same as that in the first embodiment except that the whole cap member is formed by flexible material, the cap member is directly joined to a passage formed substrate and no flexible part is provided as shown in FIG. 10.

For the flexible material, paper, the inner surface of which is coated with resin and an aluminum film can be given as an example. The change of pressure in inside space can be absorbed by the deformation of the cap member.

Such flexible material is relatively low-priced, the cost of molding and others can be also reduced and In addition, effect that the cap member can be readily joined to the passage formed substrate by welding aluminum for example is produced.

In this embodiment, to securely join the cap member, the cap member is joined onto an elastic film 50, however, the present invention is not limited to this and it need scarcely be the that the cap member may be joined onto the passage formed substrate or a lower electrode film 60.

Other Embodiments

The embodiments of the present invention are described above, however, the basic constitution of the ink jet recording head according to the present invention is not limited to the above constitution.

For example, in the above embodiments a pressure generating chamber 12 and a reservoir 14 are formed in a passage formed substrate 10, however, a member for forming a common ink chamber may be also provided in the passage formed substrate 10.

Figure 11:
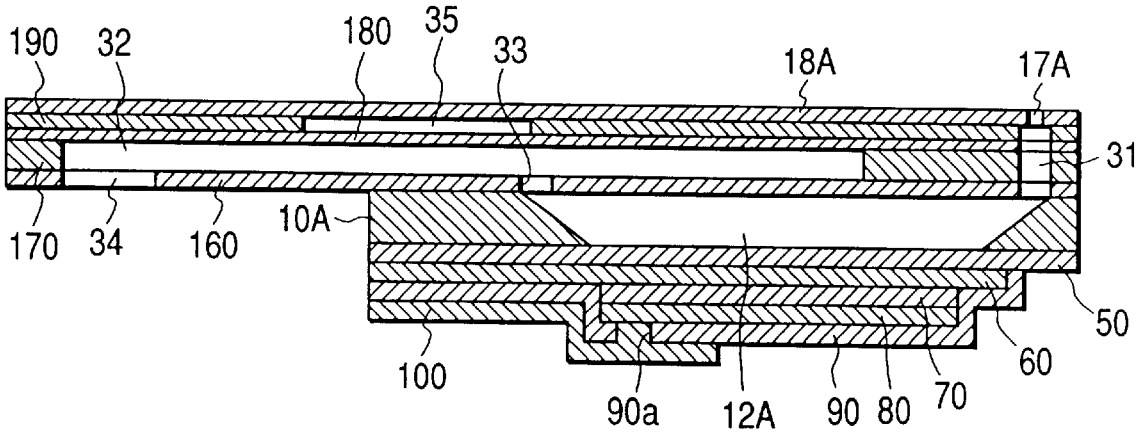
FIG. 11 shows the sectional structure of an ink jet recording head according to another embodiment of the present invention in the longitudinal direction of a pressure generating chamber.

FIG. 11 shows the partial section of an ink jet recording head constituted as described above. In this embodiment, a sealing plate 160, a common ink chamber forming plate 170, a thin plate 180 and an ink chamber side plate 190 are held between a nozzle substrate 18A in which nozzle apertures 17A are made and the passage formed substrate 10A and a nozzle communicating port 31 for connecting the pressure generating chamber 12A and the nozzle aperture 17A is arranged through these. That is, a common ink chamber 32 is formed by the sealing plate 160, the common ink chamber forming plate 170 and the thin plate 180, and each pressure generating chamber 12A and the common ink chamber 32 are connected via an ink communicating hole 33 made in the sealing plate 160.

An ink lead-in hole 34 for leading ink from the outside to the common ink chamber 32 is also made in the sealing plate 160.

A through part 35 is formed in a position opposite to each common ink chamber 32 in the ink chamber side plate 190 located between the thin plate 180 and the nozzle substrate 18A, pressure generated when an ink droplet is jetted and directed on the reverse side to the nozzle aperture 17A can be absorbed by the thin wall 180 and hereby, unnecessary positive or negative pressure can be prevented from being applied to another pressure generating chamber via the common ink chamber 32. The thin plate 180 and the ink chamber side plate 190 may be also integrated.

In such an embodiment, the failure of the operation of the piezoelectric active part caused by the change of pressure can be also prevented by providing a flexible part for absorbing the change of pressure in space for sealing the piezoelectric active part to the cap member provided on the reverse side to the open face of the passage formed substrate 10A for sealing a piezoelectric active part.

In the above embodiments, a thin film type of ink jet recording head manufactured by applying a film forming and lithographic process is described as an example, however, naturally, the present invention is not limited to this and the present invention can be applied to an ink jet recording head with various structure such as an ink jet recording head in which substrates are laminated and pressure generating chambers are formed, an ink jet recording head in which a piezoelectric film is formed by sticking a green sheet, screen process printing and others and an ink jet recording head in which a piezoelectric film is formed by crystal growth.

Further, in the above embodiments, a connection between an upper electrode film and a lead electrode may be provided in any location, at any end of a pressure generating chamber or in the center.

The example that the insulating layer is provided between the piezoelectric vibrator and the lead electrode is described above, however, the present invention is not limited to this, for example an anisotropic conductive film may also be thermically welded to each upper electrode without providing an insulating layer and the anisotropic conductive film may be also connected to a lead electrode using, bonding technique such as wire bonding.

Figure 12:
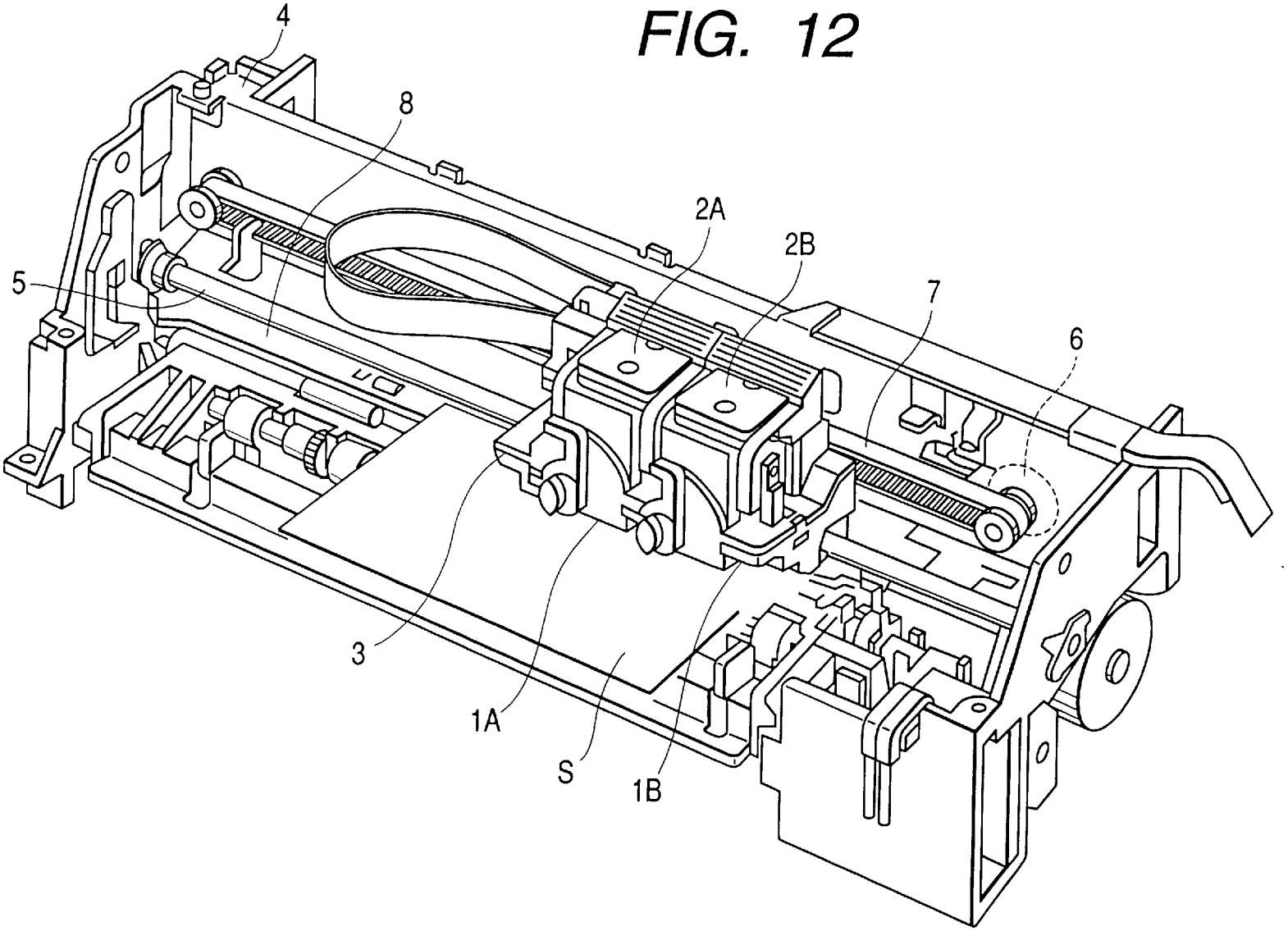
FIG. 12 shows a schematic representation view of an embodiment of the ink jet recording apparatus to which the present invention is applied.

The ink jet recording head described in the preferred embodiment is constructed of a part of an ink jet recording head unit including an ink flow path communicated with an ink cartridge or the like, and is loaded on an ink jet recording apparatus. FIG. 12 is showing a schematic representation view of an embodiment of the ink jet recording apparatus to which a present invention is applied.

As shown in FIG. 12, head units 1A and 1B include the ink jet recording head, respectively. Cartridges 2A and 2B serving as ink supply means are detachably provided on the head units 1A and 1B, respectively. The head units 1A and 1B are loaded on carriage 3. The carriage, which is moved in the axis direction, is provided on a carriage axis 5 mounted on a main body 4. The head units 1A and 1B expel, for example, a black ink composite and a color ink composite.

Then, a driving force generated by a driving motor 6 is transmitted to the carriage 3 through a plurality of gears (not shown) and a timing belt 7 to move the carriage having the head units 1A and 1B along the carriage axis 5.

On the other hand, on the main body 4, the platen 8 is provided along with the carriage 3. The platen 8 takes up a recording sheet serving as a recording media such as paper supplied by a supply roller to transmit the recording media.

As described above, the present invention can be applied to an ink jet recording head with various structure to achieve the object.

As described above, according to the present invention, as a cap member provided with a concave portion composed of space to the extent that the driving of a piezoelectric active part is not prevented is provided and a flexible part for absorbing the change of pressure in the concave portion is provided to the cap member, the failure of the operation of the piezoelectric active part caused by external environment can be prevented and the failure of the operation caused by the change of pressure in the concave portion can be also prevented.

What is claimed is:

1. An ink jet recording head comprising:

a nozzle;

a passage formed substrate having partitions forming at least a row of pressure generating chambers, said pressure generating chambers communicating with said nozzle;

an elastic film forming a part of said pressure generating chambers;

a piezoelectric vibrator formed on a side of said elastic film opposite to said pressure generating chambers;

a cap member joined to said side of said elastic film that includes said piezoelectric vibrator, said cap member including a space, said joined cap member thereby sealing said space which isolates said piezoelectric vibrator without preventing movement of said piezoelectric vibrator; and pressure change absorbing means for absorbing a change of pressure in the space of the cap member.

2. The ink jet recording head according to claim 1, wherein the pressure change absorbing means is an elastic porous member provided in the cap member.

3. The ink jet recording head according to claim 1, wherein the pressure change absorbing means is a flexible part provided in the cap member, and the space in the cap member is sealed from the outside by the flexible part.

4. The ink jet recording head according to claim 1, wherein a dummy pressure generating chamber to which ink is not supplied is provided next to the pressure generating chamber, and the pressure change absorbing means is a flexible plate forming a boundary between the dummy pressure generating chamber and the space in the cap member.

5. The ink jet recording head according to claim 4, wherein the flexible plate is defined by at least an elastic film of the dummy pressure generating chamber.

6. The ink jet recording head according to claim 1, wherein the whole cap member is made of flexible material.

7. The ink jet recording head according to claim 6, wherein the flexible material is one of paper, the inner surface of which is coated; and or aluminum.

8. The ink jet recording head according to claim 6, wherein the flexible material is joined to the passage formed substrate by welding aluminum.

9. The ink jet recording head according to claim 1, wherein the pressure generating chambers are formed by applying anisotropic etching to a silicon monocrystalline substrate, and each layer of the piezoelectric vibrator is formed by forming a film and lithography.

10. The ink jet recording head according to claim 1, wherein said passage formed substrate includes a reservoir connected to the pressure generating chambers, and a nozzle plate provided with nozzle apertures is joined to said passage formed substrate.

11. The ink jet recording head according to claim 1, wherein a passage unit for forming a common ink chamber for supplying ink to the pressure generating chamber and a passage for connecting the pressure generating chamber and the nozzle aperture is joined to the passage formed substrate.

12. A ink jet recording apparatus comprising:

an ink jet recording head as claimed in any one of claims 1 to 11.

* * * * *